US006446637B2

(12) United States Patent
Gueret

(10) Patent No.: US 6,446,637 B2
(45) Date of Patent: Sep. 10, 2002

(54) ANGLED TOOTH APPLICATOR, SYSTEM AND METHOD OF PRODUCT APPLICATION

(75) Inventor: Jean-Louis H. Gueret, Paris (FR)

(73) Assignee: L'Oreal S.A., Paris (FR)

( * ) Notice: Subject to any disclaimer, the term of this patent is extended or adjusted under 35 U.S.C. 154(b) by 0 days.

(21) Appl. No.: 09/813,004

(22) Filed: Mar. 21, 2001

Related U.S. Application Data

(63) Continuation-in-part of application No. PCT/FR00/01436, filed on May 26, 2000.

(30) Foreign Application Priority Data

Jul. 21, 1999 (FR) ..... 99 09451

(51) Int. Cl.[7] ..... A45D 40/26
(52) U.S. Cl. ..... 132/218; 401/129; 132/901
(58) Field of Search ..... 132/218, 313, 132/317, 901, 108, 109, 110, 112, 116; 401/121, 122, 126, 127, 129

(56) References Cited

U.S. PATENT DOCUMENTS

| | | | |
|---|---|---|---|
| 155,977 | A | 10/1874 | Rogers |
| 466,496 | A | 1/1892 | Heysinger |
| 791,690 | A | 6/1905 | Grell |
| 1,094,013 | A | 4/1914 | Peterson |
| 1,580,365 | A | 4/1926 | Bechtold |
| 1,670,161 | A | 5/1928 | Meyer |
| 1,780,206 | A | 11/1930 | McKellar |
| 1,829,228 | A | 10/1931 | Lewis |
| 1,892,749 | A | 1/1933 | Philaja |
| 1,963,289 | A | 6/1934 | Vardeman |
| 1,989,185 | A | 1/1935 | Clein |
| 2,175,344 | A | 10/1939 | Friedman |
| 2,255,618 | A | 9/1941 | Huppert |
| 2,264,346 | A | 12/1941 | Tupper |
| 2,348,339 | A | 5/1944 | Golden |
| 2,395,002 | A | 2/1946 | Kemmer |

(List continued on next page.)

FOREIGN PATENT DOCUMENTS

| | | |
|---|---|---|
| DE | 25 59 273 | 7/1977 |
| EP | 0 038 524 | 10/1981 |
| EP | 0 204 466 | 12/1986 |
| EP | 0 474 934 | 3/1992 |
| FR | 1 531 835 | 5/1968 |
| FR | 2 564 712 | 11/1985 |
| FR | 2 744 608 | 8/1997 |
| FR | 2 748 636 | 11/1997 |
| FR | 2 769 808 | 4/1999 |
| GB | 265 027 | 2/1927 |
| GB | 2 146 520 | 4/1985 |
| GB | 2 159 699 | 12/1985 |
| GB | 2 256 586 | 12/1992 |
| JP | 7-322915 | 12/1995 |
| JP | 9-108033 | 4/1997 |
| JP | 10-215944 | 8/1998 |
| WO | WO 95/17837 | 7/1995 |
| WO | WO 97/28719 | 8/1997 |

*Primary Examiner*—Todd E. Manahan
(74) *Attorney, Agent, or Firm*—Finnegan, Henderson, Farabow, Garrett & Dunner, L.L.P.

(57) ABSTRACT

An applicator includes an application element configured to apply a product to eyelashes and/or eyebrows. The application element includes a support, and at least one row of teeth extending from the support. At least one of the teeth includes a base having an oblong cross-section. The oblong cross-section may be angularly positioned in a direction forming a non-zero acute angle with the axis of the row and/or a non-zero acute angle with the longitudinal axis of the support. An applicator system includes the applicator in combination with a receptacle for containing the product. Also provided is a cosmetic application method using the applicator.

97 Claims, 2 Drawing Sheets

U.S. PATENT DOCUMENTS

| | | | |
|---|---|---|---|
| 2,569,246 | A | 9/1951 | Marcellus |
| 2,596,296 | A | 5/1952 | Shields |
| 2,626,618 | A | 1/1953 | Collison |
| 2,655,925 | A | 10/1953 | Ulvad |
| 2,806,476 | A | 9/1957 | Thompson |
| 3,312,583 | A | 4/1967 | Rochlis |
| 3,669,130 | A | 6/1972 | Petroczky |
| 3,763,870 | A | 10/1973 | Montgomery et al. |
| 3,862,639 | A | 1/1975 | Schefer et al. |
| 3,892,248 | A | 7/1975 | Kingsford |
| 3,921,650 | A | 11/1975 | Montgomery |
| 3,930,280 | A | 1/1976 | Vasas |
| 4,403,624 | A | 9/1983 | Montgomery |
| 4,422,986 | A | 12/1983 | Cole |
| 4,561,456 | A | 12/1985 | Gueret |
| 4,565,205 | A | 1/1986 | Taylor |
| 4,635,659 | A | 1/1987 | Spatz |
| 4,660,582 | A | 4/1987 | Taylor |
| 4,712,936 | A | 12/1987 | Kessler |
| 4,744,377 | A | 5/1988 | Dolan, Jr. |
| 4,804,004 | A | 2/1989 | Taylor |
| 5,007,442 | A | 4/1991 | Hirzel |
| 5,046,213 | A | 9/1991 | Curtis et al. |
| 5,086,793 | A | 2/1992 | Kingsford |
| 5,137,387 | A | 8/1992 | Byrd et al. |
| 5,161,554 | A | 11/1992 | Fitjer |
| 5,765,573 | A | 6/1998 | Gueret |
| 5,918,994 | A | 7/1999 | Gueret |
| 5,951,185 | A | 9/1999 | Kingsford et al. |
| 6,053,179 | A | 4/2000 | Lhuisset |

ANGLED TOOTH APPLICATOR, SYSTEM AND METHOD OF PRODUCT APPLICATION

This application is a continuation-in-part (CIP) of copending PCT international application No. PCT/FR00/01436, filed May 26, 2000, which claims the benefit of priority of French Application No. 99/09451, filed Jul. 21, 1999.

The present invention pertains to applicators, and methods of using such applicators, for applying a product. In particular, the present invention is directed to an applicator for the application of a product, such as a cosmetic product or a care product, for example, to the eyelashes, eyebrows, or other types of hair. The invention also relates to an applicator system including the applicator and a receptacle for containing the product to be applied.

European Patent Application EP-A-0 474 934 discloses a brush for applying mascara to eyelashes. The brush includes a circularly-symmetrical cylindrical body and brush members aligned parallel to the longitudinal axis of the brush. The brush members have circular cross-sections and are offset relative to one another in the longitudinal direction.

German Patent Application DE-A-2 559 273 also discloses a brush for applying mascara. The brush includes a hollow, circularly-symmetrical cylindrical body and brush members aligned parallel to the longitudinal axis of the brush. The brush members have triangular cross-sections. Long sides of the triangular cross-sections are parallel to the longitudinal axis of the support.

European Patent Application EP-A-0 204 466 also discloses a brush for applying mascara. The brush has brush members aligned parallel to the longitudinal axis of the support.

French Patent Application FR-A-2 564 712 discloses an applicator having two arrangements of teeth aligned parallel to one another. The teeth have bases with triangular shaped cross-sections. A short side of each triangle shape is parallel to axes of alignment of the teeth. A height of the triangle shape, extending from the opposite vertex, is perpendicular to the axes of alignment.

French Patent Application FR-A-2 748 636 discloses a mascara applicator including thin teeth arranged parallel to the longitudinal axis of the applicator.

It would be desirable if such known devices could be further improved to be capable of taking up a relatively large quantity of substance and thereby provide satisfactory endurance between refills. It would also be desirable if such devices could be improved to engage hairs, in particular the eyelashes, so as to smooth the substance over their surfaces and to lengthen them.

One aspect of the present invention relates to an applicator for applying a product to at least eyelashes and/or eyebrows. The applicator comprises an application element configured to apply a product to at least the eyelashes and/or eyebrows. The application element comprises a support, and at least one row of teeth extending from the support. At least one of the teeth comprises a base having an oblong cross-section.

According to one aspect, the oblong cross-section is angularly positioned in a direction forming a non-zero acute angle with the axis of the row. According to another aspect, the oblong cross-section is angularly positioned in a direction forming a non-zero acute angle with the longitudinal axis of the support. In yet another aspect, the oblong cross-section is angularly positioned in a direction forming a non-zero acute angle with the axis of the row and a non-zero acute angle with the longitudinal axis of the support, wherein the two angles may be identical, substantially identical, or different.

As used herein, the "direction" of the angular positioned oblong cross-section refers to the direction in which a longitudinal axis of the oblong cross-section is arranged. For example, when the oblong cross-section is substantially rectangular shaped, the direction of such a cross-section would correspond to the longitudinal axis parallel to the two longer sides of the rectangular shape. As another example, when the cross-section is substantially in the shape of an ellipse, the direction would correspond to a major axis of the ellipse.

As used herein, the term "axis of the row" refers to the axis along which the teeth in a row are arranged. For example, the axis of the row could be substantially straight or curved. The axis of the row could be either identical to or different from the axis of the support. The teeth in the row may be a succession of consecutive teeth.

The applicator may have just one row of teeth (or more than one row of teeth), essentially forming a comb. Alternatively, the applicator may have more than one row of teeth disposed around the applicator, essentially forming a brush. For example, the applicator may include one row of teeth disposed on a substantially opposite side of the applicator as another row of teeth.

In another aspect, more than one tooth may have a base with an oblong cross-section and one or more of such teeth may have a base positioned in a direction forming a non-zero acute angle with the axis of the row and/or a non-zero acute angle with the axis of the support. For example, all of the teeth could have bases with oblong cross-sections angularly positioned to form non-zero acute angles with respect to the axis of the row and/or the axis of the support.

When a plurality of the teeth have angularly positioned oblong bases, the direction of each cross-section could be either substantially the same or different and/or each direction could form substantially the same angle with one or more of the axes.

Optionally, the angular positioning of the bases of the teeth provides an application element capable of taking up a quantity of substance that is sufficiently large. The angular positioning optionally also enables the teeth to engage hairs, in particular the eyelashes, while the application element is being moved relative thereto, in a direction perpendicular to the longitudinal axis of the support. For example, an applicator according to the invention may make it possible to have a relatively large quantity of substance between the teeth while spreading the substance onto the eyelash surface, without the teeth losing their capacity to engage with and curve an eyelash.

In one aspect, bases of at least two consecutive teeth in the row may either contact one another or lack contact with one another.

In another aspect, consecutive teeth in the row may be mutually overlapping when the application element is observed from the side, in a direction perpendicular to the axis of the row and/or the axis of the support. Optionally, the overlapping teeth may form a substantially V-shaped notch therebetween, and the notch may be configured such that a hair is capable of being engaged therein. For example, the bottom of the notch may be situated at a non-zero distance from the support.

The profile of the above-mentioned V-shaped notch may converge towards the support. The notch may be configured so that substance present between the teeth may be spread in a satisfactory manner over the surface of the hair engaged in the notch, all the way to the end of the hair.

There are many different possible shapes for the oblong cross-section of the base. In one possible embodiment, the oblong cross-section may have a substantially rectangular shape. In other examples, the oblong cross-section may be substantially in the shape of an oval, an ellipse, or a triangle.

In another aspect, one or more teeth may have a tapered cross-section extending over at least a portion of the tooth height from adjacent the support toward a tooth free end.

In still another aspect, at least some of the teeth may have a free end portion having a shape chosen from cylindrical, substantially cylindrical, and curved.

In one embodiment, a tuft of bristles may be mounted on the support. For example, the tuft may be along the row of teeth.

Optionally, at least the support and the teeth are an integral, one-piece arrangement. For example, the application element may be formed by molding, die stamping, or any other method of shaping material.

In a further aspect, one or more of the teeth may comprise a gliding agent for improving gliding of the hair on the teeth. The gliding agent may be chosen from polytetrafluoroethylene, graphite, silicones, molybdenum disulfide, and derivatives thereof. The gliding agent could either be a coating on an exterior surface of the teeth or a filler incorporated in plastic material of the teeth. For example, the teeth could be formed by molding plastic material containing the gliding agent. The gliding agent may prevent hair from being gripped too strongly by the teeth, and thereby improve application comfort.

In an even further aspect, the application element may be formed of a material chosen from elastomer, metal, and alloy.

In yet a further aspect, the application element may have a first end and a second end opposite to the first end (e.g., front and rear ends), wherein a number of the teeth between the first end and the second end may range from about 20 to about 50. Alternatively, the number of teeth in a row of consecutive teeth may range from about 6 to about 50, or from about 10 to about 35, or from about 15 to about 32.

The teeth may be made of either the same material as the support or a different material. The height of the teeth may vary. The height of each of the teeth may range from about 0.5 mm to about 15 mm. Alternatively, the height of each of the teeth may range from about 0.5 mm to about 10 mm. Alternatively, the height of the teeth may range from about 7 mm to about 13 mm.

In yet another aspect, the row of teeth may comprise teeth having bases offset in alternation, at least in part, on either side of a geometrical separation plane containing the axis of the row.

In one example, the above-mentioned angle(s) formed by the direction of the cross-section and at least one of the axes is less than or equal to about 45°.

In one more aspect, the support may have a polygonal cross-section in a plane perpendicular to the longitudinal axis of the support, and the application element may further comprises a plurality of rows of teeth, each on a different main face of the support.

In one optional arrangement, a stem (e.g., wand) may be provided with the application element being on an end of the stem. The stem may extend from a handle element configured in the form of a closure cap for closing a receptacle. The application element may be integrally molded with the stem.

The application element can be disposed on a distal end portion of the stem. The application element may be made more flexible than the stem. For example, the application element may be made of a plastic having greater flexibility than a plastic used to make the stem. Greater comfort may be obtained when using such an applicator.

As an alternative, the stem may be more flexible than the application element. For example, the stem may be made of a plastic that is more flexible than the material used to make the application element. It is possible, for manufacturing reasons, to use a relatively inflexible material to make the application element and to compensate for the inflexibility of the application element at the time of application, using the flexibility of the stem.

The longitudinal axis of the support and the longitudinal axis of the stem may be parallel or form a non-zero angle.

The applicator may be part of a system including a receptacle configured to contain the product. A cosmetic product, such as mascara for example, may be contained in the receptacle. The receptacle may include an opening configured to permit passage of at least a part of the application element into the receptacle. The receptacle may have a wiper configured to remove excess product from the teeth of the application element when the applicator is removed from the receptacle. In an embodiment, the wiper is deformable, and may include a block of open-cell foam or an elastomeric lip, or other similar suitable configurations.

The system also may include a cap disposed on an end of the stem opposite to the end of the stem at which the application element is disposed. The cap may be configured to sealably close the opening of the receptacle.

The application element may be produced by molding plastic as a single piece with the applicator stem and with a sealing member configured to seal the receptacle closed when it is not in use. The sealing member may have a surface shaped to fit in a sealed manner into the neck of the receptacle.

There are many different types of receptacles that could be used with the applicator system. For example, the product could be stored in a tube-like receptacle. This tube may be made of a flexible material which when squeezed can dispense product onto the application element of the applicator device. Other dispensers also can be used to dispense the product onto the application element, such as a pump-type dispenser, for example, and are considered within the scope of the invention.

Alternatively, the receptacle could be configured to hold a solid cake of the product. This solid cake could be moistened in order to enable the applicator device to be loaded with product by placing the application element in contact with the moistened part of the product. Alternatively, the application element could be moistened and then placed in contact with the product to transfer moisture to the product.

When the product is contained in either a dispenser or a cake arrangement, the proximal end of the applicator device may lack a handle or a cap, since the applicator device can be arranged such that it is not stored in the receptacle containing the product or closing off such a receptacle. In such an arrangement, the stem itself can be used as a handle.

Another aspect of the invention includes a method of applying a product to the eyelashes using an applicator or system as described in the preceding paragraphs. The method includes loading a product on at least some of the teeth and placing at least some of the teeth in contact with the eyelashes such that the product coats the eyelashes. The loading may include inserting at least a portion of the applicator into a receptacle containing the product, removing the applicator from the receptacle, and wiping the excess product from the teeth, for example, with a wiper. The loading alternatively may include either dispensing the product from the receptacle onto the teeth or contacting the teeth with a solid cake of product. The solid cake of product may be moistened and the teeth may be placed in contact with the moistened cake of product. In the latter form of loading, the moistening of the product may include either moistening the product and then contacting the teeth with the product or moistening the product with a pre-moistened applicator.

The method may optionally comprise gripping the eyelashes between adjacent teeth.

In one example of a method according to the invention, the product being applied is mascara. If the mascara includes fibers, the method may further include orienting the fibers with the teeth such that the fibers are substantially parallel to the eyelashes as the product is applied.

The applicator of the invention, as described above, may be used for applying a cosmetic product, such as mascara, to the eyelashes. However, the applicator could be used to apply other products to other surfaces. In addition, the applicator according to the present invention could also be used to comb the eyelashes or eyebrows, for example.

The application element and stem could be configured to permit connection and disconnection of the application element from the stem. With such a structural configuration, the method may further comprise connecting the application element to the stem. The method may also comprise selecting the application element from a group of differing application elements.

Aside from the structural and procedural arrangements set forth above, the invention could include a number of other arrangements, such as those explained hereinafter. It is to be understood that both the foregoing description and the following description are exemplary, and are intended to provide further explanation of the invention as claimed.

The accompanying drawings are included to provide a further understanding of aspects of the invention and are incorporated in and constitute a part of this specification. The drawings illustrate embodiments of the invention and, together with the description, serve to explain some of the principles of the invention.

In the drawings.

Reference will now be made in detail to some embodiments of the invention, examples of which are illustrated in the accompanying drawings. Wherever possible, the same reference numbers are used in the drawings and the description to refer to the same or like parts.

Figure 1:
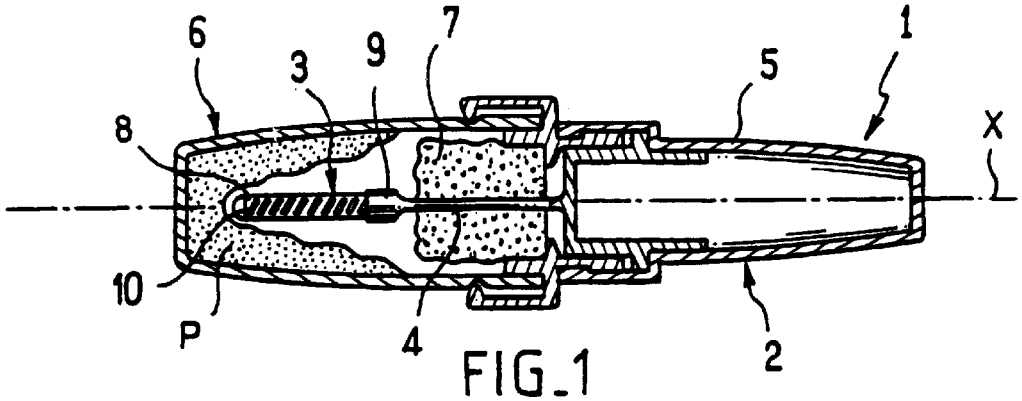
FIG. 1 is a diagrammatic axial cross-section view of an embodiment of an applicator system in accordance with the invention.

An applicator system 1 according to an aspect of the present invention is shown in FIGS. 1 through 4. The applicator system 1 includes a receptacle 6 containing a product P, for example, a cosmetic product such as mascara, and an applicator 2. Applicator 2 includes a stem 4 having a longitudinal axis. An elongated application element 3 is disposed on one end of the stem 4 and a handle or grasping element 5 is disposed at an opposite end. Handle or grasping element 5 may be in the form of a cap for closing the receptacle 6.

Figure 7:
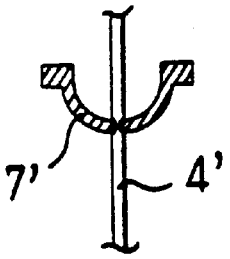
FIG. 7 is a diagrammatic section view showing a variant embodiment of a wiper member for the system of FIG. 1.

The receptacle 6 may include a wiper 7 configured to wipe the application element 3 as it is withdrawn from the receptacle 6. Wiper 7 may be made of a block of open-cell foam, as shown in FIG. 1, or an elastomeric material, or other similar suitable material. Other types of wipers may be used, such as, for example, a flexible lip 7' as shown in FIG. 7, which is optionally made of an elastomer and/or flocked. The wiper may be configured such that it flexes or deforms to the shape of the application element 3 as it passes through the wiper. If the system includes the alternative wiper 7' shown in FIG. 7, the stem may provided with a necked-down region 4' (as compared to the remainder of the stem) that comes level with the edge of the lip 7' when the applicator is in place in the receptacle.

If the receptacle 6 is not in use, it may be sealed closed, for example, by providing a sealing member on the grasping element 5 or, alternatively, on the stem 4.

As shown in FIGS. 1–4, the application element 3 may be essentially in the form of a comb that includes a single row of teeth 10 extending from an elongated support 8 having a longitudinal axis X, which may be substantially parallel to, or angled with respect to, the longitudinal axis of the stem 4. In the example of FIG. 1, the longitudinal axis X of the support 8 is coincident with the longitudinal axis of the stem 4. When the longitudinal axis of the support 8 and the longitudinal axis of the stem 4 are angled, the applicator may be more ergonomic.

Figure 2:
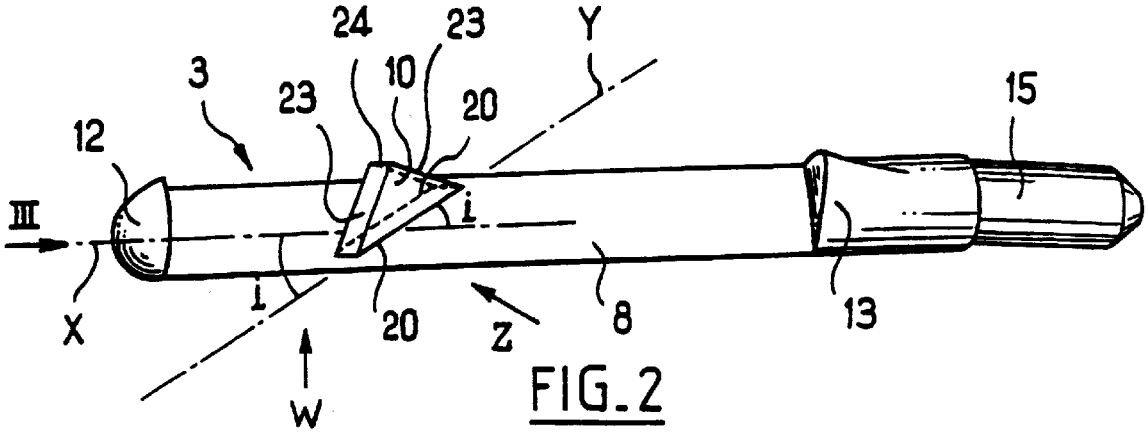
FIG. 2 is a diagrammatic fragmentary view of an application element shown in FIG. 1.
Figure 3:
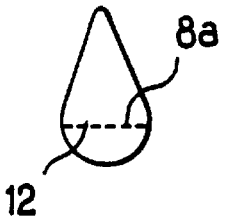
FIG. 3 is a front end view looking along arrow III of the application element of FIG. 2.

FIG. 2 is a fragmentary view of the application element 3, with only one of its teeth 10 being shown, in order to preserve the clarity of the drawing. Teeth 10 may be molded as a single piece with support 8 using plastic. FIG. 2 shows that the support 8 may have a front portion 12 and a rear portion 13 that are shaped to make it easier for the support to pass through the wiper 7 during insertion into the receptacle and removal therefrom. For example, the front and rear portions 12 and 13 may be tapered. As shown in FIG. 3, the front portion 12 of the application element 3, when viewed along the axis X, may have a drop-shaped profile.

The rear portion 13 may be connected to an endpiece 15 configured to be fixed in a recess formed in the end 9 of the stem 4. The endpiece 15 could be removably connected to the stem 4 so that the application element 3 could be separated from the stem 4, or, alternatively, the application element 3 and stem 4 could be coupled to one another without enabling removal of the application element 3. When the application element 3 is removably connected, a differently configured application element could be substituted in place of the existing application element.

As shown in FIG. 2, each tooth 10 has a base (i.e., portion of the tooth 10 adjacent to the support 8) having an oblong shaped cross-section. The cross-section of a tooth 10 may be in a plane parallel to the surface 8*a* (see FIG. 4) of the support 8, and/or in a plane parallel to a line tangent to the surface 8*a* (e.g., when the surface 8*a* is curved), and/or in a plane perpendicular to the height direction of the tooth 10, for example.

There are many different types of oblong shapes for the cross-section of the base of the tooth. In the example of FIG. 2, the base of each tooth 10 has a rectangular cross-section having long sides 20 and a longitudinal axis extending parallel to an axis Y forming a non-zero acute angle i with the axis X. The example of FIG. 2 also has each tooth 10 forming a triangular profile, when the tooth is observed from the side in a direction Z perpendicular to the axis Y, wherein each tooth 10 includes sides 23 converging as the tooth 10 extends away from support 8 toward the tooth vertex (i.e., tooth free end) 24.

Figure 4:
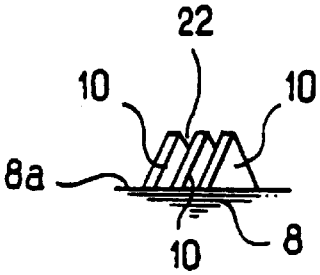
FIG. 4 is a fragmentary side view of the application element, showing how V-shaped notches are formed between the teeth.

In the example described, two consecutive teeth 10 may overlap, as shown in FIG. 4, when the application element 3 is observed from the side, i.e., in a direction W perpendicular to the axis X and parallel to the plane of the surface 8*a* of the support 8. FIG. 4 shows an example of how the consecutive teeth 10 may form a V-shaped notch 22 optionally configured to engage an eyelash while the application element 3 is being moved in a direction substantially parallel to the eyelashes and perpendicular to the axis X. The bottom of each of the notches 22 may be spaced a distance greater than zero above the surface 8*a* of the support 8.

Figure 5:
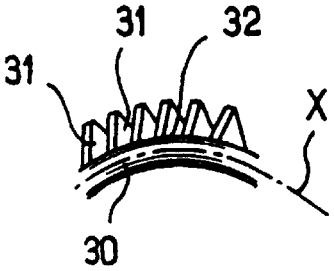
FIG. 5 is a side view showing a curved support with a row of teeth on a convex face of the support.
Figure 6:
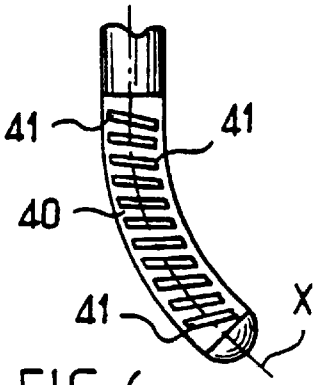
FIG. 6 is a plan view of a curved support.

FIGS. 5 and 6 show examples wherein the support may be curved. FIG. 5 shows a side view of a support 30 provided with a succession of teeth 31, each of which has an oblong base forming a non-zero acute angle with the longitudinal axis X. The teeth 31 are connected to an outwardly convex face 32 of the support, thereby angularly positioning them so as to make it easier for the eyelashes to engage between them.

FIG. 6 is a plan view showing a support 40 provided with a row of teeth 41, each of which has a base forming a non-zero acute angle with the longitudinal axis X. The support 40 is curved in a direction substantially parallel to the plane of the face from which the teeth 41 extend.

The spacing between the bases of the teeth in the row may vary.

The support may have a cross-section (i.e., a section perpendicular to the axis X) that is circular, elliptical, polygonal, or any other shape.

Figure 8:
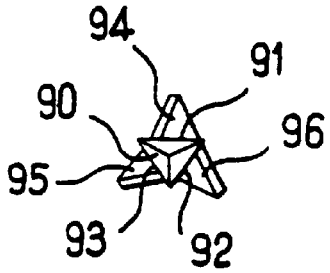
FIG. 8 is a front end view of an application element including a support having a polygonal cross-section, with respective rows of teeth on all of its faces.

By way of example, FIG. 8 shows a support 90 having a triangular cross-section. The support 90 has three planar faces 91, 92, and 93 from which respective rows of teeth 94, 95, and 96 extend. These rows of teeth have oblong bases that are not perpendicular to the longitudinal axis of the support 90. As shown in FIG. 8, the front portion of the support 90 may be tapered so as to facilitate its insertion through the wiper member 7.

In the examples shown in FIGS. 1–6 and 8, the teeth extend from the application element between the front and rear end portions of the application element, and the rear end portion of the application element may be connected to the stem.

Figure 9:
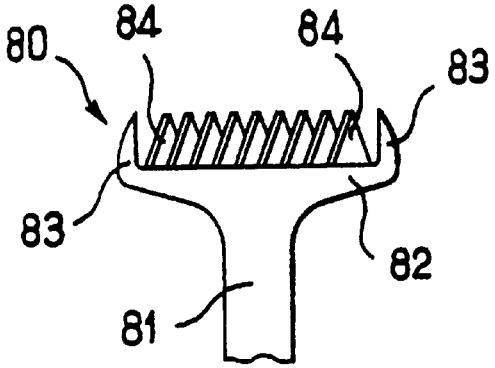
FIG. 9 is a side view of a variant embodiment of an application element of the invention.

Alternatively, as shown in FIG. 9, the support may be arranged so that a longitudinal axis of the support is substantially non-parallel (e.g., perpendicular) to the stem so that teeth are arranged between side portions of the application element. In the example of FIG. 9, a flat stem 81 is connected to an application element 80 including a support 82 whose longitudinal axis 82 is perpendicular to the longitudinal axis of the stem 81. The support 82 is provided with side portions 83 between which one or more rows of teeth according to the invention are disposed, e.g., at least one row of teeth 84 like the above-described teeth 10.

Figure 10:
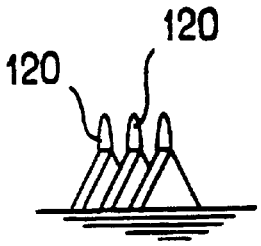
FIG. 10 is a view similar to FIG. 4, showing a variant embodiment.

FIG. 10 shows an example wherein the teeth may have a frustoconical or triangular base and a top portion in the form of a spike 120 having a shape chosen from one of cylindrical, substantially cylindrical, and curved.

In the above-mentioned embodiments shown in FIGS. 1–6, the axis of the row of teeth is substantially parallel to the longitudinal axis X of the support. Other arrangements for the axis of the row are possible. For example, the axis of the row may form an angle with respect to the axis X.

Figure 12:
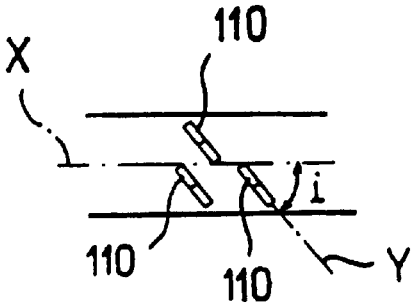
FIG. 12 is a fragmentary plan view showing the teeth disposed in a staggered configuration.

It is possible for the teeth not to have bases that are strictly aligned in the same row, and the row may, for example, have teeth whose bases are disposed so that they are staggered relative to the axis of the row, as shown in FIG. 12. FIG. 12 shows teeth 110 situated in alternation on either side of a midplane of symmetry of the support, wherein the plane contains the axis X.

Figure 11:
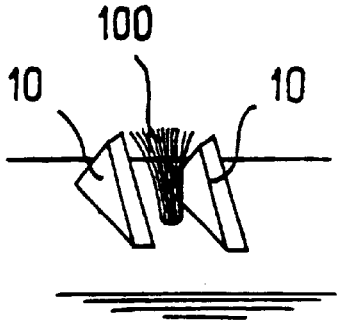
FIG. 11 is a view analogous to FIG. 2, showing a tuft of bristles mounted on the support.

As shown in FIG. 11, the application element may be provided with tufts of bristles 100 between the teeth. The application element differs from the application element shown in FIG. 2 in that it is provided with respective tufts of bristles 100 between consecutive teeth 10.

The invention is not restricted to the embodiments which have just been described. For example, there are many different types of teeth that could be provided on the applicator. In particular it is possible to change the shape and configuration of the teeth, e.g., by using teeth of differing shapes and/or teeth, and tufts, within the same application element. The teeth may have shapes other than those shown in the drawings and the teeth need not have the same shape as each other. The teeth may also have flocking.

In general, the particular features of each of the embodiments described may be combined, according to the type of product to be applied and the application effect desired.

The overall height of the each teeth may be uniform, or the height of at least some teeth may differ from the height of at least some other teeth.

The overall length of a row of consecutive teeth may optionally range from about 10 mm to about 45 mm, or from about 15 mm to about 28 mm. Another optional range for the overall length of a row of successive teeth is from about 20 mm to about 26 mm.

As mentioned above, the invention is not limited to an application element having one row of teeth configured in the form of a comb, but may also include application elements including a number of rows of teeth, essentially forming either a comb or a brush, for example.

The application element may be substantially flexible, allowing it to bend as the product is being applied. When the surface of the support on which the teeth are disposed is convex, as shown in FIG. 5, the convex configuration may cause adjacent teeth to diverge away from each other, thus allowing a relatively large amount of product to be contained between adjacent teeth and consecutive teeth. Moreover, such an arrangement may achieve improved loading of the teeth with product as the application element is withdrawn through a wiper. This is because the force of the wiper on the application element may tend to straighten the axis of the application element and cause the teeth to move toward each other, particularly toward a middle portion (along the length) of the application element. As the teeth move toward each other, product may be forced between the teeth toward the base portion, again allowing the application element to hold a relatively large amount of product.

The application element may include a succession of teeth including a first and a second series of teeth which alternate, the teeth of the first series having a different shape, than the teeth of the second series. One of the series of teeth may itself be made up of teeth with differing shapes or even differing heights.

The teeth may have a height varying according to the axial position along the application element, for example a height which increases, decreases, decreases then increases, or increases then decreases from one end of the application element to the other.

The teeth may have a surface condition which increases the amount of product with which the application element becomes laden. For instance, the teeth and/or the support may include capillary grooves or flocking, over all or parts of their surface.

The teeth may undergo a surface treatment by abrasion so as to form forks at the ends of the teeth, for example.

The teeth may undergo a heat treatment, for example, to round their tips or form a bubble at their free end. The teeth may thus become less aggressive toward the eyelashes.

The teeth and/or the support may be also coated with a gliding agent, such as a lacquer or Teflon, for example, to make them glide better along the eyelashes or, alternatively, to give them greater roughness. Such gliding agents may alternatively, or in addition be added to the material used to form the teeth.

The application element, or a portion thereof, such as the teeth, may also include active ingredients, such as preservatives, moisturizers, copper salts, magnetic particles, and other similar suitable materials, to be released into the product when the product is loaded onto the application element. These active ingredients can either be included in the material used to form the application element, or can be coated onto the application element, or both. In addition, products that modify the surface tension of the application element upon contact with moisture can be used to form the teeth or to coat the teeth.

The application element may be made by the injection-molding of plastic, but as an alternative, use may be made of methods for shaping material by compression, stamping or turning.

The support may include grooves or reliefs configured to hold the product.

The application element may include a part allowing it to be removably connected to the stem. As an alternative, the application element may be produced by molding plastic as a single piece with the applicator stem. The application element may have two substantially opposite ends and a portion located between the ends. One of the substantially opposite ends of the application element can be connected to a distal end portion of the stem, and a longitudinal axis of the application element may extend either at an angle to or substantially parallel to a longitudinal axis of the stem. Alternatively, the portion of the application element located between the two substantially opposite ends may be connected to a distal end portion of the stem, and the longitudinal axis of the application element may be substantially perpendicular to the longitudinal axis of the stem. The stem may be substantially flat.

The stem may include a connector at a distal end portion and the application element may be engageable with the connector. For example, the connector could define a slot configured to receive the application element.

It will be apparent to those skilled in the art that various modifications and variations can be made to the structure and methodology of the present invention. Thus, it should be understood that the invention is not limited to the embodiments and examples discussed in the specification. Rather, the present invention is intended to cover modifications and variations.

What is claimed is:

1. An applicator for applying a product to at least one of eyelashes and eyebrows, the applicator comprising:

an application element configured to apply a product to at least one of eyelashes and eyebrows, the application element comprising a support, and at least one row of teeth extending from the support, the at least one row of teeth having a longitudinal axis, wherein at least one of the teeth comprises a base having an oblong cross-section, the oblong cross-section being angularly positioned in a direction forming a non-zero acute angle with the axis of the row.

2. The applicator of claim 1, wherein each of a plurality of teeth in the row comprises a base having an oblong cross-section angularly positioned in a respective direction forming a non-zero acute angle with the axis of the row.

3. The applicator of claim 2, wherein each of the teeth in the row comprises a base having an oblong cross-section.

4. The applicator of claim 2, wherein the support includes a longitudinal axis, and wherein each respective direction forms a non-zero acute angle with the longitudinal axis of the support.

5. The applicator of claim 1, wherein bases of at least two consecutive teeth in the row contact one another.

6. The applicator of claim 1, wherein bases of at least two consecutive teeth in the row lack contact with one another.

7. The applicator of claim 1, wherein the support includes a longitudinal axis, and wherein the direction forms a non-zero acute angle with the longitudinal axis of the support.

8. The applicator of claim 1, wherein the oblong cross-section is angularly positioned so that a longitudinal axis of the oblong cross-section is in the direction.

9. The applicator of claim 1, wherein consecutive teeth in the row are mutually overlapping when the application element is observed from the side, in a direction perpendicular to the axis of the row.

10. The applicator of claim 9, wherein the overlapping teeth form a substantially V-shaped notch therebetween, and wherein the notch is configured such that a hair is capable of being engaged therein.

11. The applicator of claim 10, wherein a bottom of the notch is situated at a non-zero distance from the support.

12. The applicator of claim 1, wherein bases of the teeth are arranged along an axis having a shape chosen from a substantially straight shape and a curved shape.

13. The applicator of claim 1, wherein the oblong cross-section has a substantially rectangular shape.

14. The applicator of claim 1, wherein each of a plurality of the teeth has a tapered cross-section extending over at least a portion of the tooth height from adjacent the support toward a tooth free end.

15. The applicator of claim 1, wherein at least some of the teeth have a free end portion having a shape chosen from cylindrical, substantially cylindrical, and curved.

16. The applicator of claim 1, further comprising a tuft of bristles mounted on the support.

17. The applicator of claim 1, wherein the tuft of bristles is along the row of teeth.

18. The applicator of claim 1, wherein the support and the teeth are an integral, one-piece arrangement.

19. The applicator of claim 18, wherein the application element is formed by one of molding and die stamping.

20. The applicator of claim 19, wherein at least the teeth are formed of plastic material containing a gliding agent for improving gliding of the hair on the teeth.

21. The applicator of claim 1, wherein at least the teeth comprise a gliding agent for improving gliding of the hair on the teeth, and wherein the gliding agent comprises a material chosen from polytetrafluoroethylene, graphite, silicones, molybdenum disulfide, and derivatives thereof.

22. The applicator of claim 1, wherein the application element is formed of a material chosen from elastomer, metal, and alloy.

23. The applicator of claim 1, wherein the application element has a first end and a second end opposite to the first end, and wherein a number of the teeth between the first end and the second end ranges from about 20 to about 50.

24. The applicator of claim 1, wherein a height of each of the teeth in the row ranges from about 0.5 mm to about 10 mm.

25. The applicator of claim 1, wherein the row of teeth comprises teeth having bases offset in alternation, at least in part, on either side of a geometrical separation plane containing the axis of the row.

26. The applicator of claim 1, wherein the angle is less than or equal to about 45°.

27. The applicator of claim 1, wherein the support has a polygonal cross-section in a plane perpendicular to a longitudinal axis of the support, and wherein the application element further comprises a plurality of rows of teeth each on a different main face of the support.

28. The applicator of claim 1, further comprising a stem, the application element being on an end of the stem.

29. The applicator of claim 28, wherein the stem extends from a handle element configured in the form of a closure cap for closing a receptacle.

30. The applicator of claim 28, wherein the application element is integrally molded with the stem.

31. The applicator of claim 28, wherein the application element is formed of a plastic material more flexible than a plastic material used to form the stem.

32. The applicator of claim 28, wherein a longitudinal axis of the support forms a non-zero angle with a longitudinal axis of the stem.

33. An applicator system comprising:

the applicator of claim 1; and a receptacle configured to contain the product.

34. The system of claim 33, further comprising:

a wiper configured to remove excess product from the teeth when the applicator is removed from the receptacle.

35. The system of claim 34, wherein the wiper is deformable.

36. The system of claim 35, wherein the wiper is chosen from an elastomeric lip and a block of foam.

37. The system of claim 33, wherein the product is contained in the receptacle and the product is a cosmetic product for the eyelashes.

38. The system of claim 37, wherein the product is mascara.

39. The system of claim 33, wherein the receptacle includes an opening configured to permit passage of at least a part of the application element into the receptacle, and wherein the system further comprises a cap at another end of the stem, the cap being configured to sealably close the opening.

40. A method of applying a product to eyelashes, comprising:

providing the system of claim 33;

loading a product on at least some of the teeth; and placing at least some of the teeth in contact with the eyelashes such that the product coats the eyelashes.

41. The method of claim 40, wherein the receptacle contains the product, and wherein the loading includes inserting the applicator into the receptacle containing the product.

42. The method of claim 41, further comprising removing the applicator from the receptacle and wiping excess product from the teeth.

43. The method of claim 40, wherein the loading the teeth includes dispensing the product from the receptacle onto the teeth.

44. The method of claim 40, wherein the loading includes contacting the teeth with a solid cake of product.

45. The method of claim 44, further comprising moistening the solid cake of product.

46. The method of claim 40, further comprising gripping the eyelashes between adjacent teeth.

47. The method of claim 40, wherein the product is mascara including fibers, and wherein the method further comprises orienting the fibers with the teeth such that the fibers are substantially parallel to the eyelashes as the product is applied.

48. The method of claim 40, further comprising connecting the application element to the stem.

49. The method of claim 48, further comprising selecting the application element from a group of differing application elements.

50. An applicator system comprising:

the applicator of claim 1; and a receptacle configured to contain the product.

51. The system of claim 50, further comprising:

a wiper configured to remove excess product from the teeth when the applicator is removed from the receptacle.

52. The system of claim 51, wherein the wiper is deformable.

53. The system of claim 52, wherein the wiper is chosen from an elastomeric lip and a block of foam.

54. The system of claim 50, wherein the product is contained in the receptacle and the product is a cosmetic product for the eyelashes.

55. The system of claim 54, wherein the product is mascara.

56. The system of claim 50, wherein the receptacle includes an opening configured to permit passage of at least a part of the application element into the receptacle, and wherein the system further comprises a cap at another end of the stem, the cap being configured to sealably close the opening.

57. A method of applying a product to eyelashes, comprising:

providing the system of claim 50;

loading a product on at least some of the teeth; and placing at least some of the teeth in contact with the eyelashes such that the product coats the eyelashes.

58. The method of claim 57, wherein the receptacle contains the product, and wherein the loading includes inserting the applicator into the receptacle containing the product.

59. The method of claim 58, further comprising removing the applicator from the receptacle and wiping excess product from the teeth.

60. The method of claim 57, wherein the loading the teeth includes dispensing the product from the receptacle onto the teeth.

61. The method of claim 57, wherein the loading includes contacting the teeth with a solid cake of product.

62. The method of claim 61, further comprising moistening the solid cake of product.

63. The method of claim 57, further comprising gripping the eyelashes between adjacent teeth.

64. The method of claim 57, wherein the product is mascara including fibers, and wherein the method further comprises orienting the fibers with the teeth such that the fibers are substantially parallel to the eyelashes as the product is applied.

65. The method of claim 57, further comprising connecting the application element to the stem.

66. The method of claim 57, further comprising selecting the application element from a group of differing application elements.

67. An applicator for applying a product to at least one of eyelashes and eyebrows, the applicator comprising:

an application element configured to apply a product to at least one of eyelashes and eyebrows, the application element comprising a support having a longitudinal axis, and at least one row of teeth extending from the support, wherein at least one of the teeth comprises a base having an oblong cross-section, the oblong cross-section being angularly positioned in a direction forming a non-zero acute angle with the longitudinal axis of the support.

68. The applicator of claim 67, wherein each of a plurality of teeth in the row comprises a base having an oblong cross-section angularly positioned in a respective direction forming a non-zero acute angle with the longitudinal axis of the support.

69. The applicator of claim 68, wherein each of the teeth in the row comprises a base having an oblong cross-section.

70. The applicator of claim 68, wherein each angularly positioned base of said plurality of teeth forms substantially the same non-zero acute angle with the longitudinal axis of the support.

71. The applicator of claim 67, wherein the oblong cross-section is angularly positioned so that a longitudinal axis of the oblong cross-section is in the direction.

72. The applicator of claim 67, wherein bases of at least two consecutive teeth in the row contact one another.

73. The applicator of claim 67, wherein bases of at least two consecutive teeth in the row lack contact with one another.

74. The applicator of claim 67, wherein consecutive teeth in the row are mutually overlapping when the application element is observed from the side, in a direction perpendicular to the longitudinal axis of the support.

75. The applicator of claim 74, wherein the overlapping teeth form a substantially V-shaped notch therebetween, and wherein the notch is configured such that a hair is capable of being engaged therein.

76. The applicator of claim 75, wherein a bottom of the notch is situated at a non-zero distance from the support.

77. The applicator of claim 67, wherein bases of the teeth are arranged along an axis having a shape chosen from a substantially straight shape and a curved shape.

78. The applicator of claim 67, wherein the oblong cross-section has a substantially rectangular shape.

79. The applicator of claim 67, wherein each of a plurality of the teeth has a tapered cross-section extending over at least a portion of the tooth height from adjacent the support toward a tooth free end.

80. The applicator of claim 67, wherein at least some of the teeth have a free end portion having a shape chosen from cylindrical, substantially cylindrical, and curved.

81. The applicator of claim 67, further comprising a tuft of bristles mounted on the support.

82. The applicator of claim 67, wherein the tuft of bristles is along the row of teeth.

83. The applicator of claim 67, wherein the support and the teeth are an integral, one-piece arrangement.

84. The applicator of claim 83, wherein the application element is formed by one of molding and die stamping.

85. The applicator of claim 84, wherein at least the teeth are formed of plastic material containing a filler for improving sliding of the hair on the teeth.

86. The applicator of claim 67, wherein at least the teeth comprise a gliding agent for improving gliding of the hair on the teeth, and wherein the gliding comprises a material chosen from polytetrafluoroethylene, graphite, silicones, molybdenum disulfide, and derivatives thereof.

87. The applicator of claim 67, wherein the application element is formed of a material chosen from elastomer, metal, and alloy.

88. The applicator of claim 67, wherein the application element has a first end and a second end opposite to the first end, and wherein a number of the teeth between the first end and the second end ranges from about 20 to about 50.

89. The applicator of claim 67, wherein a height of each of the teeth in the row ranges from about 0.5 mm to about 10 mm.

90. The applicator of claim 67, wherein the row of teeth comprises teeth having bases offset in alternation, at least in part, on either side of a geometrical separation plane containing the axis of the row.

91. The applicator of claim 67, wherein the angle is less than or equal to about 45°.

92. The applicator of claim 67, wherein the support has a polygonal cross-section in a plane perpendicular to a longitudinal axis of the support, and wherein the application element further comprises a plurality of rows of teeth each on a different main face of the support.

93. The applicator of claim 67, further comprising a stem, the application element being on an end of the stem.

94. The applicator of claim 93, wherein the stem extends from a handle element configured in the form of a closure cap for closing a receptacle.

95. The applicator of claim 93, wherein the application element is integrally molded with the stem.

96. The applicator of claim 93, wherein the application element is formed of a plastic material more flexible than a plastic material used to form the stem.

97. The applicator of claim 93, wherein the longitudinal axis of the support forms a non-zero angle with a longitudinal axis of the stem.

* * * * *